US011033167B2

(12) United States Patent
Yang

(10) Patent No.: US 11,033,167 B2
(45) Date of Patent: Jun. 15, 2021

(54) TOILET CLEANERS

(71) Applicant: Lin'an Thumb Cleaning Products Co., Ltd, Zhejiang (CN)

(72) Inventor: Xiaohua Yang, Zhejiang (CN)

(73) Assignee: Lin'an Thumb Cleaning Products Co., Ltd, Hangzhou (CN)

( * ) Notice: Subject to any disclaimer, the term of this patent is extended or adjusted under 35 U.S.C. 154(b) by 97 days.

(21) Appl. No.: 16/509,456

(22) Filed: Jul. 11, 2019

(65) Prior Publication Data

US 2020/0268228 A1 Aug. 27, 2020

(30) Foreign Application Priority Data

Feb. 27, 2019 (CN) ..... 201910145657.X

(51) Int. Cl.

| | |
|---|---|
| ***A47L 13/17*** | (2006.01) |
| ***A47L 13/46*** | (2006.01) |
| ***A47K 11/10*** | (2006.01) |
| *A46B 7/04* | (2006.01) |
| *A46B 3/08* | (2006.01) |
| *A47L 13/16* | (2006.01) |

(Continued)

(52) U.S. Cl.

CPC ..... *A47L 13/17* (2013.01); *A47K 11/10* (2013.01); *A47L 13/46* (2013.01); *A46B 3/08* (2013.01); *A46B 7/00* (2013.01); *A46B 7/04* (2013.01); *A47K 11/00* (2013.01); *A47L 13/16* (2013.01)

(58) Field of Classification Search

CPC ..... A47L 13/17; A47L 13/46; A47L 13/10; A47L 13/16; A47K 11/10; A47K 11/00; A47K 17/00; A46B 3/08; A46B 7/00; A46B 7/04; A46B 5/0095; A46B 2200/304

See application file for complete search history.

(56) References Cited

U.S. PATENT DOCUMENTS 4,031,673 A * 6/1977 Hagelberg ..... A47K 11/10 451/517
7,059,008 B2 * 6/2006 Morgan ..... A46B 3/08 15/147.1

(Continued)

FOREIGN PATENT DOCUMENTS

CN 100518612 C 7/2009
CN 203137438 U 8/2013

(Continued)

*Primary Examiner* — Monica S Carter
*Assistant Examiner* — Katina N. Henson

(57) ABSTRACT

A toilet cleaner, including a head and a handle for clamping the head. The handle includes a housing, a manipulation component, and a clamping jaw. A clamping end of the housing is provided with a first clamping head and is hinged to a middle portion of the clamping jaw. The manipulation component is fitted in the housing and includes a handling portion at a grip end of the housing. An outer end of the clamping jaw has a second clamping head corresponding to the first clamping head, and the manipulation component is connected to an inner end of the clamping jaw, so that the first clamping head and the second clamping head are matched with each other. The present invention is more firm and reliable with better compatibility, so that the handle can conveniently and reliably clamp the heads in different thicknesses, or of various brands, forms or specifications.

8 Claims, 9 Drawing Sheets

(51) Int. Cl.
*A46B 7/00* (2006.01)
*A47K 11/00* (2006.01)

(56) References Cited

U.S. PATENT DOCUMENTS 7,386,910 B2 * 6/2008 Minkler ..... A47K 11/10
15/145
9,655,482 B2 * 5/2017 Michelson ..... A47K 17/00

FOREIGN PATENT DOCUMENTS

CN 207220749 U 4/2018
CN 208822641 U 5/2019

* cited by examiner

TOILET CLEANERS

CROSS-REFERENCE TO RELATED APPLICATIONS

This application claims the benefit of priority from Chinese Patent Application No. 201910145657.X, filed on Feb. 27, 2019. The content of the aforementioned application, including any intervening amendments thereto, is incorporated herein by reference in its entirety.

TECHNICAL FIELD

The present application relates to cleaning of toilets (e.g., a pedestal pan, a squatting pan, a urinal), and more particularly to a toilet cleaner.

BACKGROUND OF THE INVENTION

Toilet needs to be regularly cleaned in consideration of health and hygiene, so as to prevent the spread of germs and avoid unpleasant odors, thus providing a more relaxing and comfortable experience during using the toilets. However, toilet cleaning is an annoying daily work, because a conventional one-piece toilet brush formed by integrating a head and a handle is used. Due to repeated use over the years, the one-piece toilet brush is hard to be thoroughly cleaned. During storing, dirt is stored in the one-piece toilet brush, thus polluting indoor environment, causing unpleasant odors and unsightly appearance; and hands will get dirty when using the toilet, so that psychological discomfort will be caused. In practice, the toilet often becomes very dirty before it is cleaned.

In this regard, Chinese Patent Application No. 200480023852.7 discloses a cleaning brush with a disposable/replaceable head. The cleaning brush is a combined type, and the handle and the head can be assembled and separated. The handle can be repeatedly used, and the head is disposable, which greatly improves the performance of the toilet brush. However, there are still many deficiencies for this kind of combined cleaning brush.

For example, the part of the handle for clamping the head is easy to be damaged. Taking the cleaning brush of the above-mentioned patent as an example, a flexible jaw is limited by an opening corresponding to housing members, and an angle between two clamping jaws of the flexible jaw is forced to be reduced to clamp the head, which has high requirements for shapes of the clamped part of the head. In reality, such head generally has a relatively high hardness when it is not immersed in water. Once the clamped part of the head is too thick, or the deformation thickness thereof caused by unevenness, bending, external force is too large, the housing members corresponding to the opening is apt to be broken, so that the clamping ability of the handle to the head is greatly reduced, and the whole handle has to be discarded.

The handle has high requirements for the part of the head to be clamped, so that there are many precautions for producing, transporting and storing the head. The part to be clamped needs to match with the handle in thickness. It is difficult to be compatible between the head and the handle of different brands, which increases the inconvenience in use.

Even if the head is adapted to the handle, during use, changes of states of the head results that the head is not firmly clamped by the handle, for example, after the head is soaked in water, it becomes loose and is easily detached from the handle. Once detached, the head is difficult to be installed again, which increases the inconvenience in use and wastes resources.

During use, dirty water can easily flow into the inner cavity of the handle, so the above-mentioned problems of the conventional toilet brush are apt to occur. In some special cases, for example, if the handle is tilted or inverted, dirty water will infuse, seep and flow into the hand-held part of the handle, thereby getting hands dirty.

After the head is used, it is not easy to loosen completely, and the toilet is more likely to be blocked after the head is thrown into the toilet to be flushed. Taking the head in the above-mentioned patent as an example, it comprises a whole brush sheet formed by stacking, flattening, compacting and binding. The brush sheet is not easy to loosen completely; however, it is difficult to be flushed down the toilet due to the long brush sheet, so that the sewage pipe of the toilet is easy to be blocked.

It is urgent to address above shortcomings.

SUMMARY OF THE INVENTION

In order to overcome the above-mentioned deficiencies in the prior art, the present invention provides a toilet cleaner. Apart of a handle for clamping a head is more firm and reliable. Technical solutions of the present invention are described as follows. A toilet cleaner is provided, comprising a head and a handle for clamping the head. The handle includes a housing, a manipulation component, and a clamping jaw. A clamping end of the housing is provided with a first clamping head and is hinged to a middle portion of the clamping jaw. The manipulation component is fitted in the housing and includes a handling portion at a grip end of the housing. An outer end of the clamping jaw is provided with a second clamping head corresponding to the first clamping head, and the manipulation component is connected to an inner end of the clamping jaw, so that the first clamping head and the second clamping head are matched with each other.

In some embodiments, the housing includes a first housing including the first clamping head and a second housing which is hinged with the clamping jaw.

In some embodiments, a cavity for accommodating the manipulation component is provided in the housing, and a seal groove close to the clamping end of the housing is provided in the cavity, and the seal groove is provided with a seal ring through which the manipulation component passes.

In some embodiments, the toilet cleaner further comprises a spring which is configured to automatically reset positions of the manipulation component and the clamping jaw relative to the housing.

In some embodiments, the manipulation component further includes a connecting rod, a guide portion, and a connecting shaft portion. A push button of the handling portion protrudes from the housing. The handling portion and the guide portion are coupled via the connecting rod. A first slide groove 101 and a second slide groove 102 are sequentially provided at the guide portion along a length direction of the guide portion. A spring seat and a guide head are provided in the housing. The connecting rod extends to the first slide groove. The spring seat is inserted into the first slide groove, and the guide head is inserted into the second slide groove. The spring is installed in the first slide groove. One end of the spring abuts against the spring seat, and the other end of the spring is sheathed on the connecting rod.

In some embodiments, the inner end of the clamping jaw includes two clamping arms opposite to each other, and each of the two clamping arms is provided with a guide groove. The manipulation component is movably coupled to the clamping jaw through the guide groove.

In some embodiments, clamping teeth are provided on opposite surfaces of the first clamping head and second clamping head in a staggered manner. An angle between the grip end and the clamping end of the housing is 20-30°, and/or an angle between a rod portion and a grip portion of the grip end is 3-8°.

In some embodiments, the head comprises a plurality of brush sheets which are sequentially stacked in a cross-interlocking manner.

In some embodiments, the toilet cleaner further comprises a storage box, in which a limit plate 31 and a partitioning plate 32 are provided in the storage box, to accommodate the head in a spaced arrangement.

In some embodiments, the head is wet, and/or the brush sheets are impregnated with a surfactant and a bactericide which are transparent and colorless.

The present invention is more firm and reliable with better compatibility, so that the handle can conveniently and reliably clamp the heads in different thicknesses, or of different brands, forms or specifications. The spring is disposed to maintain the clamping of the handle and the head in a continuous engagement state. Therefore, the clamping is more stable, avoiding dropping of the head in use, and facilitating clamping the head with one hand again.

BRIEF DESCRIPTION OF THE DRAWINGS

The present invention will be further described in detail below with reference to the accompanying drawings and specific embodiments.

Figure 1:
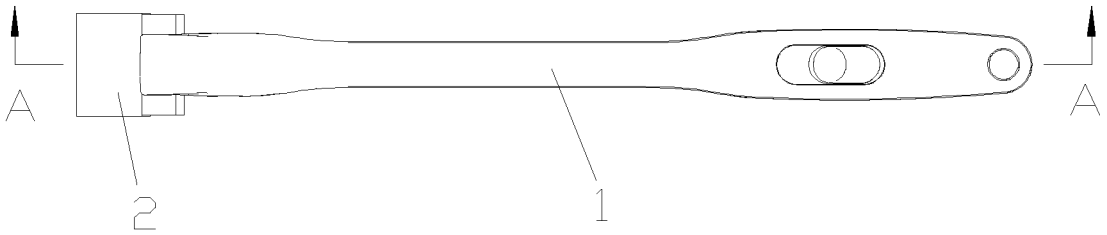
FIG. 1 is a front view of a toilet cleaner according to an embodiment of the present invention.

REFERENCE NUMERALS handle 1; head 2; first housing 11; manipulation component 12; clamping jaw 13; second housing 14; opening 111; first clamping head 112; first semi-ring groove 113; first clamping tooth 114; handling portion 121; push button 1210; connecting rod 122; first slide groove 101; second slide groove 102; connecting shaft portion 123; lug 124; spring 125; seal ring 126; guide groove 131; hinge shaft 132; second clamping head 133; spring seat 141; guide head 142; second semi-ring groove 143; connection arm 144; hinge hole 145; slit 20; first brush sheet 21; second brush sheet 22; storage box 3; limit plate 31; and partitioning plate 32.

DETAILED DESCRIPTION OF EMBODIMENTS

The present invention will be further described below in conjunction with embodiments.

In this embodiment, illustrated is a toilet cleaner, as shown in FIG. 1, including a handle 1 which is permanently and repeatedly used and is configured to clamp a head 2.

Figure 2:
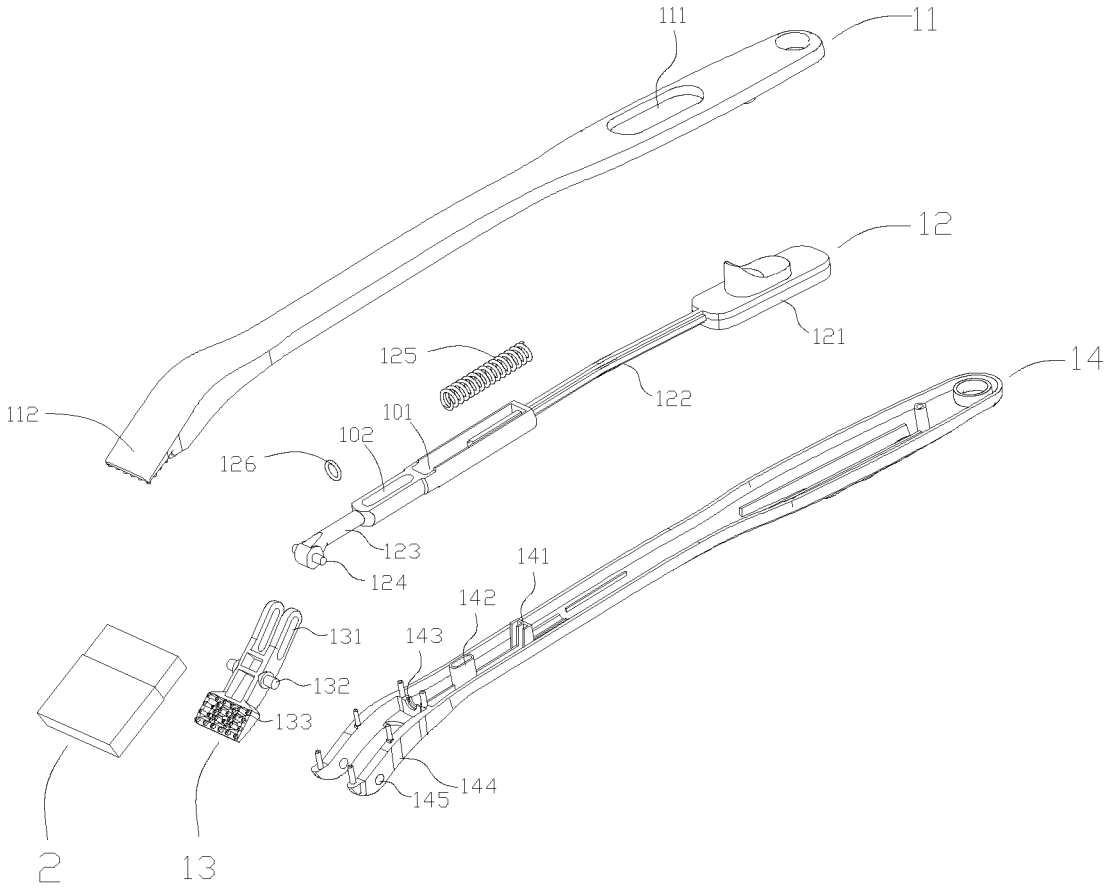
FIG. 2 is an exploded view of the toilet cleaner in FIG. 1.
Figure 4:
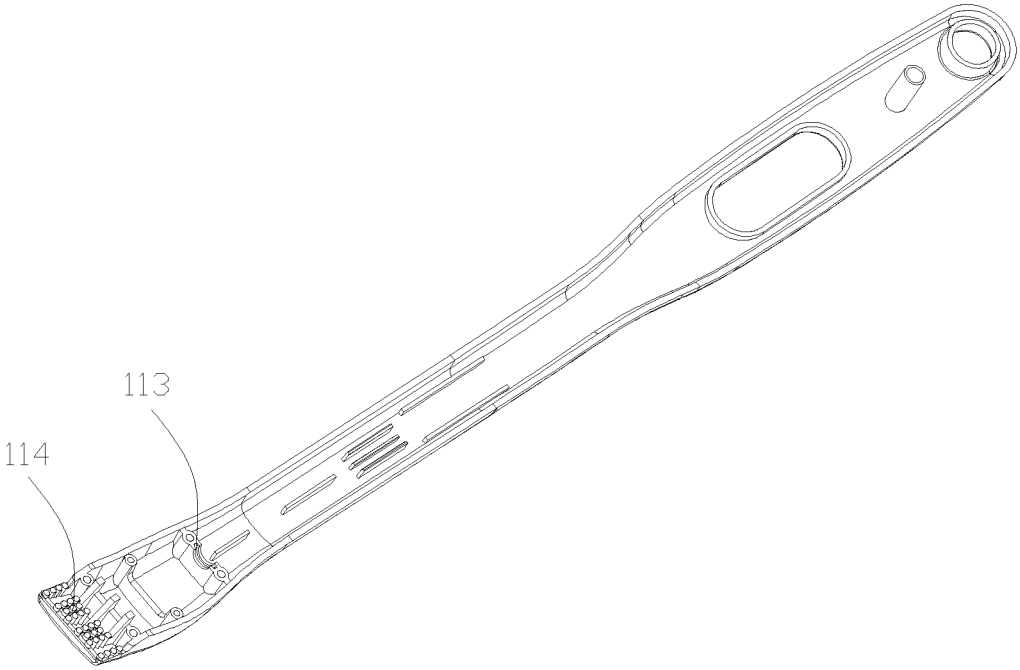
FIG. 4 is a schematic diagram of a first housing in FIG. 2.

In this embodiment, as shown in FIG. 2, the handle 1 includes a first housing 11, a manipulation component 12, a clamping jaw 13 and a second housing 14. An opening 111 is provided at a grip end of the first housing 11. and a clamping end of the first housing includes a first clamping head 112. As shown in FIG. 4, a guide rail is provided at an inner wall of a middle portion of the first housing 11 for facilitating a slide of the manipulation component 12. A first semi-ring groove 113 is provided at an inner wall of the clamping end of the first housing 11. A plurality of first clamping teeth 114 are staggered on the first clamping head 112. The manipulation component 12 includes a handling portion 121, a connecting rod 122, a guide portion and a connecting shaft portion 123 in sequence. The handling portion 121 includes a slide base and a push button 1210 which are in a one-piece structure. The handling portion 121 and the guide portion are connected through the connecting rod 122, and a cross-section of the connecting rod 122 is cross-shaped, which enhances the plastic strength of the connecting rod 122. A first slide groove 101 and a second slide groove 102 are sequentially provided at the guide portion along a length direction of the guide portion. One end of the connecting rod 122 extends to the first slide groove 101. One end of the connecting shaft portion 123 is connected to the connecting rod 122, and a lug 124 is symmetrically provided at the other end of the connecting shaft portion 123. An inner end of the clamping jaw 13 includes two clamping arms opposite to each other, and guide grooves 131 in an arc shape are symmetrically provided on the two clamping arms. A middle portion of the clamping jaw 13 includes a hinge shaft 132 integrally formed with the clamping jaw 13. An outer end of the clamping jaw 13 includes a second clamping head 133. A guide rail is provided at an inner wall of a grip end of the second housing 14 for facilitating a slide of the handling portion 121. A spring seat 141 and a guide head 142 are provided on an inner wall of a middle portion of the second housing 14, and respectively correspond to the first slide groove 101 and the second slide groove 102. A second semi-ring groove 143 is provided at an inner wall of the second housing 14 close to a clamping end of the second housing. Two connection arms are symmetrically provided at one end of second housing 14 close to the clamping jaw 13, and are provided with hinge holes 145 at an outer end thereof. In some embodiments, the connection arms 144 are solid, avoiding storing dirt.

Figure 3:
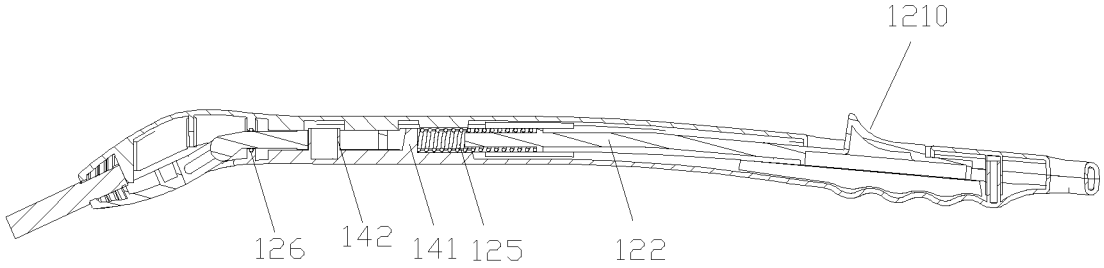
FIG. 3 is a sectional view of the toilet cleaner along A-A in FIG. 1.

The toilet cleaner is assembled as follows. As shown in FIG. 3, the first housing 11 and the second housing 14 are fastened together in a snap fit and a screwed connection to form a housing in which a cavity is formed for accommodating the manipulation component 12. The push button 1210 of the handling portion 121 extends from the opening 111. The spring seat 141 is inserted into the first slide groove 101, and the guide head 142 is inserted into the second slide groove 102. The spring seat 141, the guide head 142 and the above guide rails are configured to limit the slide of the manipulation component 12. The first semi-ring groove 113 and the second semi-ring groove 143 are spliced into an annular seal groove in which a seal ring 126 is disposed. The connecting shaft portion 123 passes through the seal ring 126 such that the seal ring plays a seal role, and when the connecting shaft portion 123 is stationary or sliding relative to the seal ring 126, the seal can be achieved between cavities at the grip end and the clamping end to avoid sewage flowing into the handle 1, so that the ability of the handle to keep self-cleaning is greatly improved. Connection structures at both ends of the connecting shaft portion 123 cooperate with the seal groove for limiting positions, that is, for limiting the slide of the manipulation component 12. At the same time, the push button 1210 and the sliding port 111 can also limit the slide of the manipulation component as mentioned above. A spring 125 is provided at the first slide groove 101, and is limited by side walls of the first slide groove 101, the inner walls of the first housing 11 and the second housing 14 to avoid uncontrollable bending. One end of the spring 125 abuts against the spring seat 141, and the other end of the spring is sheathed on the end of the connecting rod 122 in the first slide groove 101, and abuts against the inner wall of the first slide groove 101, so that the spring 125 is in a compressed state.

The lug 124 on the connecting shaft portion 123 is inserted into the guide groove 131 of the clamping jaw 13. During installation, the lug can be installed by adjusting a gap between two clamping arms of the clamping jaw 13 based on the elastic formation thereof, or the installation can also be implemented in a way that the lug 124 and the connecting shaft portion 123 are separated, so that the manipulation component 12 and the clamping jaw 13 are movably connected. The hinge shaft 132 is inserted into the hinge hole 145, and the specific installation manner can refer to the above-mentioned methods, so that the clamping jaw 13 is hinged with the second housing 14. When the manipulation component 12 telescopically slides, the lug 124 slides along the guide groove 131 for automatically adjusting the distance between the connecting shaft portion 123 and the hinge shaft 132, and for enabling the clamping jaw 13 to rotate at a certain angle.

Since the spring 125 is always in a compressed state, in use, the manipulation component 12 is driven to the clamping jaw 13 by pushing the push button 1210 with a finger, so that the second clamping head 133 opens relative to the first clamping head 112. In practice, the openness degree is determined according to the shapes, thickness, states, and the like of the head to be clamped. After the head 2 is adjusted in place, the finger releases the push button 1210, and the manipulation component 12 moves toward a reset direction under a restoring force of the spring 125, thereby driving the clamping jaw 13, so that the second clamping head 133 engages with the first clamping head 112, thus clamping and maintaining the head 2. The structure is more firm and reliable with better compatibility, so that the handle can conveniently clamp the heads in different thicknesses, different brands and various forms, specifications, and states. The spring is disposed to maintain the clamping of the handle and the head in a continuous engagement state. Therefore, the clamping is more stable, avoiding the dropping of the head in use, and facilitating clamping the head with one hand again.

In some embodiments, clamping teeth of the clamping head are respectively provided at opposite sides of the first clamping head 112 and the second clamping head 133. In some embodiments, the first clamping teeth 114 of the first clamping head 112 and the second clamping teeth of the second clamping head 133 are arranged in a staggered manner (such as engaged or crossed), so that the head 2 is better clamped by the brush hand 1. In some embodiments, an angle between the grip end and the clamping end of the housing is 20-30°, such as 25°, resulting that the head 2 is fully manipulated by the handle Land cleaning for multiple parts and angles of toilets in various types and specifications is easily achieved, particularly the cleaning for sidewalls and edges of the toilets. In some embodiments, an angle between a rod portion and a grip portion of the grip end of the handle 1 is 3-8°, such as 5°, which is more conducive for thoroughly manipulating the head 2 by the handle 1.

Figure 5:
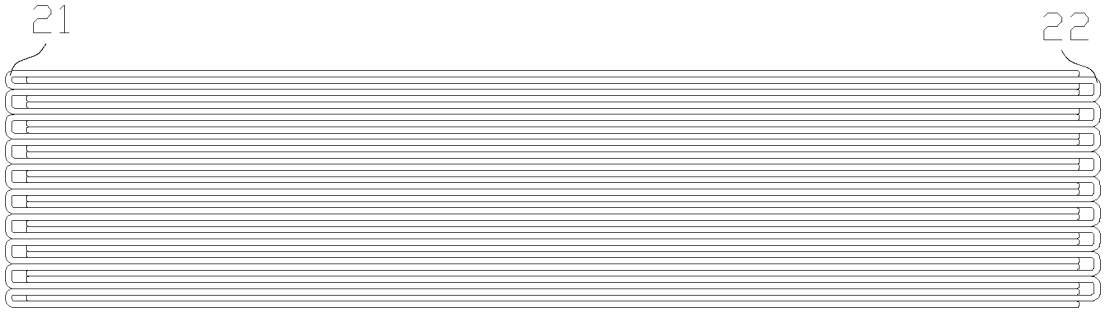
FIG. 5 is a side view of a head of the toilet cleaner.

In some embodiments, the head 2 is formed as shown in FIG. 5, i.e., the head 2 includes a plurality of brush sheets which are sequentially stacked in a cross-interlocking manner. Taking a first brush sheet 21 and a second brush sheet 22 for example, the first brush sheet 21 is folded in a right direction, and the second brush sheet 22 is folded in a left direction, and the two folded brush sheets are stacked in a cross-interlocking manner, and other brush sheets are placed in the same manner, so that the sheets are stacked and interlocked to form a block which will not loosen. The advantages of the formation are as follows. 1) The brush sheets can be stripped from the head 2 according to the actual cleaning requirements, thereby saving resources, and avoiding affecting the clamping of the handle 1 to the head. 2) The handle 1 can ensure the clamping for the head 2, and the brush sheets are prone to spreading in use. On one hand, gaps between the brush sheets are increased, so that the performance of storing dirt is improved, and each brush sheet can be fully used to maximize the cleaning effect. On the other hand, it is also beneficial for the full utilization and quick dissolution of surfactants and disinfectants and the like impregnated with the brush sheets, thereby improving the cleaning ability and efficiency, so that waste is avoided. Moreover, after the cleaning, the brush sheets are prone to loosening, and can be directly discharged into the sewage pipe through the toilet flush, and the toilet and the sewage pipe will not be blocked, which is more convenient and practical. In some embodiments, the brush sheet is made of a non-woven fabric.

In some embodiments, the surfactant and disinfectant impregnated with the head 2 are transparent and colorless, or have an aromatic odor. Comparing to conventional colored surfactants and disinfectants, the surfactant and disinfectant can be first used to clean the outer wall, the edge of the toilet without leaving staining marks, and then to clean the inner wall of the toilet. Meanwhile, the present invention is very convenient and clean, and can avoid cleaning the outer wall and the edge of the toilet with toilet paper, towel and wet wipes by hand in the conventional manner which is inconvenient and easy to get the hands dirty. In some embodiments, the head 2 is wet, so that the outer wall, the edge of the toilet can be directly cleaned in use without wetting the head again.

Figure 6:
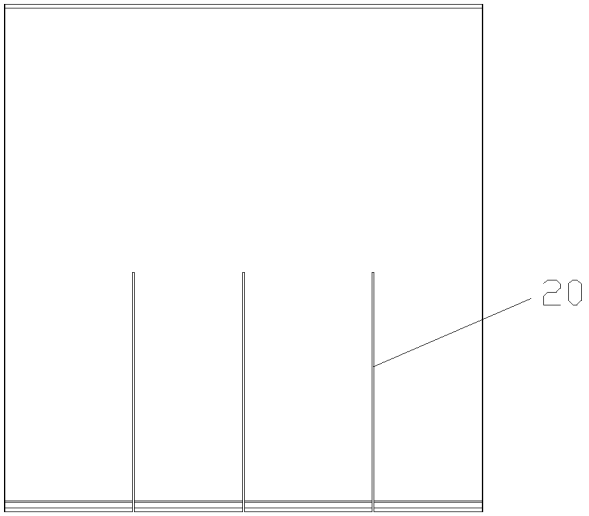
FIG. 6 is a top view of the head of the toilet cleaner in FIG. 5.

In some embodiments, the head 2 is further formed as shown in FIG. 6, i.e., a plurality of slits are formed at a cleaning end of the brush sheets of the head 2 in a thickness direction of the head. A plurality of slits 20 are arranged in parallel, thereby further improving the looseness performance of the cleaning end of the head 2 and the cleaning performance.

Figure 7:
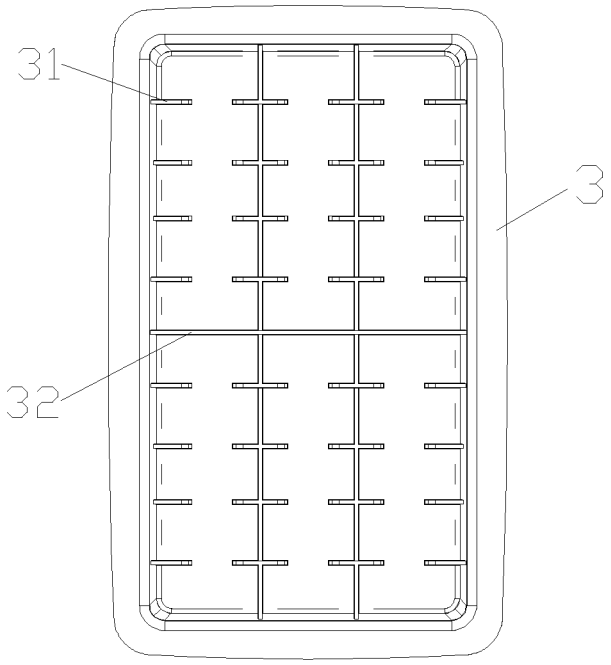
FIG. 7 is a top view of a storage box.
Figure 8:
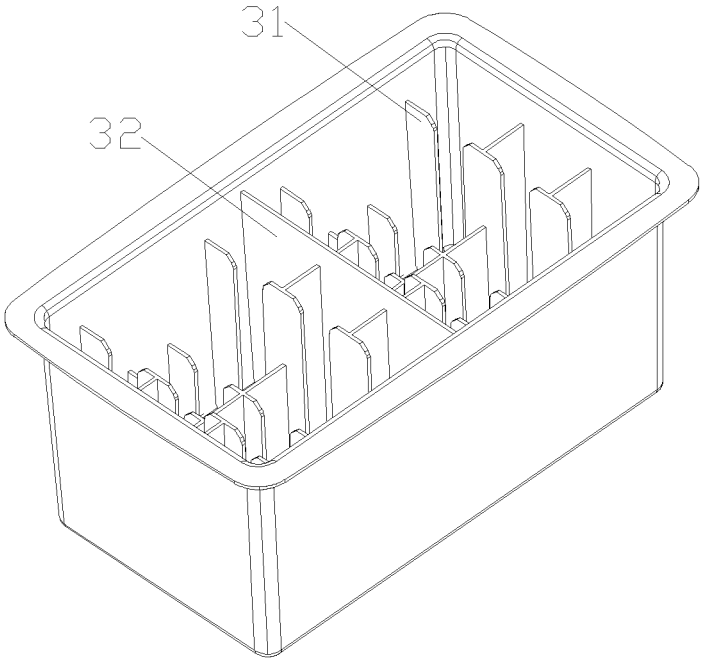
FIG. 8 is a perspective view of the storage box in FIG. 7.
Figure 9:
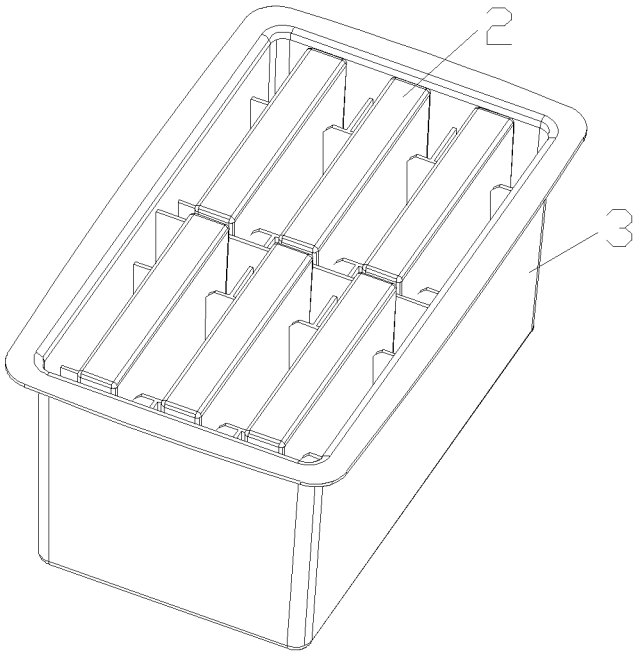
FIG. 9 is a schematic diagram of the storage box in a use state in FIG. 7.

In some embodiments, the toilet cleaner further includes a storage box 3 as shown in FIGS. 7 and 8. The storage box 3 is used for accommodating the head 2, and a limit plate 31 and a partitioning plate 32 are disposed therein. As shown in FIG. 9, the limit plate 31 and the partitioning plate 32 can serve to accommodate the heads 2 in a spaced arrangement. The advantages of the storage box are described as follows. There is no need to hold the head 2 by hands, and the head is easily clamped by manipulating the handle 1 with one hand to respectively insert the first clamping head 112 and the second clamping head 133 into gaps at both sides of the head 2, and widths of the gaps are larger than thicknesses of the clamping heads, so that the storage box 3 and/or adjacent heads 2 can be kept clean, which is more sanitary and convenient.

It should be understood that modifications or variations can be made by those skilled in the art based on the above descriptions, and all those modifications and variations shall fall within the scope of the appended claims of the present invention.

The above is some exemplary embodiments of the present invention, and obviously the implementation of the present invention is not limited thereto. Various modifications based on the concept and principle of the present invention, or applications of the present invention without modification, shall fall within the scope of the appended claims.

What is claimed is:

1. A toilet cleaner, comprising a head and a handle for clamping the head;

wherein the handle comprises a housing, a manipulation component and a clamping jaw; the housing comprises a first housing and a second housing; an-end of the first housing close to the head is provided with a first clamping head; and the second housing is hinged to a middle portion of the clamping jaw; the manipulation component is fitted in the housing and comprises a handling portion at an end of the housing close to the handle; the manipulation component further comprises a connecting rod, a guide portion and a connecting shaft portion; wherein the handling portion, the connecting rod, the guide portion and the connecting shaft portion are arranged in sequence; an end of the clamping jaw close to the head is provided with a second clamping head corresponding to the first clamping head, and the manipulation component is connected to an end of the clamping jaw away from the head, so that the first clamping head and the second clamping head are matched with each other;

the end of the clamping jaw away from the head comprises two clamping arms opposite to each other, and each of the two clamping arms is provided with a guide groove; and the manipulation component is movably coupled to the clamping jaw through the guide groove;

a lug is symmetrically provided at an end of the connecting shaft portion close to the head; and the lug is inserted into the guide groove of the clamping jaw;

a middle portion of the clamping jaw comprises a hinge shaft integrally formed with the clamping jaw;

two connection arms are symmetrically provided at one end of the second housing close to the clamping jaw, and are provided with hinge holes at an end of the two connection arms close to the head; and the hinge shaft is inserted into the hinge holes, so that the clamping jaw is rotatable; when the manipulation component telescopically slides, the lug is slidable along the guide groove for automatically adjusting a distance between the connecting shaft portion and the hinge shaft.

2. The toilet cleaner of claim 1, wherein the first housing and the second housing are fastened together in a snap fit to form a cavity therebetween for accommodating the manipulation component; a seal groove close to the end of the housing close to the head is provided in the cavity; and the seal groove is provided with a seal ring through which the manipulation component passes.

3. The toilet cleaner of claim 1, further comprising a spring configured to automatically reset positions of the manipulation component and the clamping jaw relative to the housing.

4. The toilet cleaner of claim 3, wherein a push button of the handling portion protrudes from the housing;

the handling portion and the guide portion are coupled via the connecting rod; a first slide groove and a second slide groove are sequentially provided at the guide portion along longitudinal direction of the guide portion; a spring seat and a guide head are provided in the housing; the connecting rod extends to the first slide groove; the spring seat is inserted into the first slide groove; the guide head is inserted into the second slide groove; the spring is installed in the first slide groove; and one end of the spring abuts against the spring seat, and the other end of the spring is sheathed on the connecting rod.

5. The toilet cleaner of claim 1, wherein clamping teeth are provided on opposite surfaces of the first clamping head and the second clamping head in a staggered manner; and an angle between the end of the housing close to the handle and the end of the housing close to the head is 20-30°.

6. The toilet cleaner of claim 1, wherein the head comprises a plurality of brush sheets which are sequentially stacked in a cross-interlocking manner.

7. The toilet cleaner of claim 1, further comprising a storage box, wherein a limit plate and a partitioning plate are provided in the storage box to accommodate the head in a spaced arrangement.

8. The toilet cleaner of claim 6, wherein the head is wet, or the brush sheets are impregnated with a surfactant and a bactericide which are transparent and colorless.

* * * * *